United States Patent [19]

Oberdorfer

[11] Patent Number: 4,773,592

[45] Date of Patent: Sep. 27, 1988

[54] HIGH-PRESSURE CLEANING EQUIPMENT

[75] Inventor: Guido Oberdorfer, Bellenberg, Fed. Rep. of Germany

[73] Assignee: 501 Wap Reinigungssysteme GmbH & Co., Fed. Rep. of Germany

[21] Appl. No.: 1,065

[22] Filed: Jan. 7, 1987

[51] Int. Cl.[4] ..... B05B 1/24; B08B 3/04

[52] U.S. Cl. ..... 239/126; 239/137; 134/98

[58] Field of Search ..... 134/98, 103; 417/26, 417/28, 38, 302, 307; 137/512; 239/124, 127, 126, 135, 136, 137, DIG. 22

[56] References Cited

U.S. PATENT DOCUMENTS

| | | | |
|---|---|---|---|
| 1,774,805 | 9/1930 | Maynard | 137/512 X |
| 2,645,243 | 7/1953 | Turner | 137/512 |
| 3,246,845 | 4/1966 | Techler et al. | 239/124 X |
| 3,383,044 | 5/1968 | Norstrud et al. | 239/305 X |
| 3,477,645 | 11/1969 | Murphy | 239/136 |
| 3,797,744 | 3/1974 | Smith | 239/305 X |
| 3,997,114 | 12/1976 | Hewett | 239/127 |
| 4,222,521 | 9/1980 | Nielsen | 239/135 |

FOREIGN PATENT DOCUMENTS 3322959 1/1985 Fed. Rep. of Germany .

*Primary Examiner*—Andres Kashnikow
*Assistant Examiner*—Kevin Patrick Weldon
*Attorney, Agent, or Firm*—Nilsson, Robbins, Dalgarn, Berliner, Carson & Wurst

[57] ABSTRACT

A high pressure cleaning equipment will be described which can be operated by either hot water or superheated steam with the addition of cleaning chemicals as required. For increased safety of operation of the equipment, a safety valve is additionally provided together with, as required, a steam valve, which in the case of steam operation, directs only a noticeably reduced amount of cleaning fluid per unit of time to a heat exchanger which converts the cleaning fluid to steam.

13 Claims, 1 Drawing Sheet

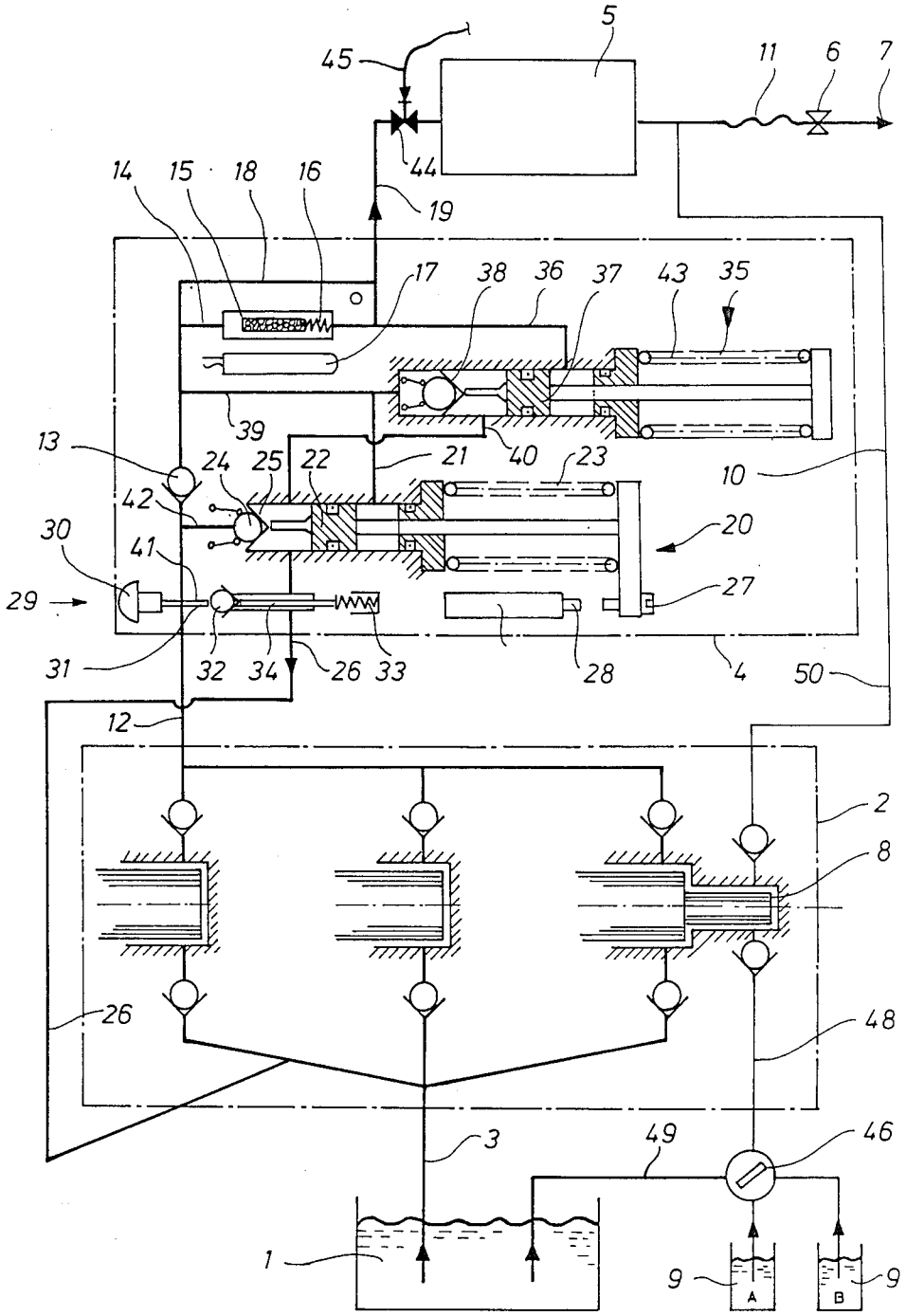
5
45
11
6
7
44
14
15
18
16
19
17
38
36
37
43
35
39
40
13
24
25
22
21
23
10
42
20
30
41
27
29
31
32
34
26
33
28
4
50
12
2
8
26
48
3
49
46
1
9
A
B
9

HIGH-PRESSURE CLEANING EQUIPMENT

BACKGROUND OF THE INVENTION

The invention concerns high-pressure cleaning equipment with a discharge jet which delivers either hot water or steam, together with as required, cleaning chemicals, with a water tank which is connected by a suction line to a high pressure pump for the cleaning fluid which, as required, also drives a pump for the cleaning chemicals, and on the pressure side of which a safety circuit is connected which contains a change-over valve which, when the pressure in the pressure side exceeds the permitted value, directs the cleaning fluid to the suction side of the pump; a pressure monitor which has a switch connected electrically to the pump drive which is operated by a pressurized piston on the pressure side; a safety valve that is pressurized in the closing direction by pump pressure and in the opening direction by the pressure prevailing in the circuit and which contains a water deficiency safety device which reacts to the flow prevailing in the discharge line from the pump to the jet, and in which a heat exchanger for heating of the cleaning fluid is also provided.

Such cleaning equipment is described in all its essential features by DE-OS No. 3 322 959 from the applicant, nevertheless not in complete detail. The invention proceeds from this state of the art.

Therein no measures are forseen to relieve and make safe a build-up of pressure on the pressure side of the equipment in the case of a blocked discharge jet, if for example the change-over valve or the pressure monitor or the safety valve or even the flow monitor are unserviceable.

Therein there are also no measures taken to provide only a noticeably reduced quantity of cleaning fluid per unit of time to the discharge jet if steam operation is to be selected. Furthermore, the equipment described therein is only designed for hot water operation.

BRIEF SUMMARY OF THE INVENTION

The invention therefore takes as its basis the technical problem of the proposal of high-pressure equipment of the type mentioned in the introduction which is functionally very safe and which, even in the case of failure of one or the other of the essential safety elements of the known safety circuit, reliably switches off before non-permissible build-up of high pressure at the pressure side of the pump occurs. Additionally it should be possible to operate the cleaning equipment either with hot water or steam without it being necessary to alter the delivery performance of the heat exchanger for the heating of the medium.

To solve this problem the invention is characterized as that in the safety circuit a safety valve is provided that contains a spring-loaded control piston which is acted upon, against the force of the spring, by the pressure prevailing on the discharge side of the water deficiency safety and whose movement, in the case of overpressure, opens a non-return valve which connects the pressure side of the pump with its suction side.

The additional safety valve provided by the invention serves therefore as the final safety so to speak, if the other essential elements of the safety circuit, or even just one of them, should fail. Additionally the safety valve also picks up the residual heat build-up after switch-off caused by heat conduction of the heating element, and at the same time also the increase in pressure cauesd by the running-on of the pump as a result of its design. The running-on causes even more rotations of the pump drive or the pump itself even after switch-off with a corresponding increase in pressure which is likewise picked up by the safety valve.

A simplification of design is served if a connection line between the safety valve and the change-over valve is provided because the pressure increase in the described situations which is relieved by the safety valve can then be relieved through this return line to the suction side of the pump which, without this, is present between the change-over valve and the suction line.

An important refinement of the invention is thus characterized in that in the connection line between the change-over valve and the suction side of the pump, a steam valve with adjustable flow suction is arranged, which is also connected to the pressure line of the pump. when the valve is closed the complete quantity of cleaning fluid goes to the heat exchanger and is heated there to warm water temperature which is then discharged through the jet at high pressure. If however the cleaning is to be operated using superheated steam (high-pressure superheated steam) the steam valve is thus opened and the greater part of the flow quantity of cleaning fluid flows back to the suction side of the pump. Only the remaining smaller part of the cleaning fluid flows through the heat exchanger to be turned into vapour (superheated steam), which is then delivered at high pressure to the spray gun (jet) without having to necessarily change the jet. At a reduction of the previous water quantity by half a steam temperature of preferably 150° C. is achieved.

The invention will be further described using one embodiment example from which arise further important features. The illustration shows a circuit diagram with the essential elements of high pressure equipment in accordance with the invention with selectable operation by hot water or steam and, as required, with the addition of cleaning chemicals.

DETAILED DESCRIPTION

Cleaning fluid is available in a water tank (1). The cleaning fluid is drawn out of the water tank by a high pressure pump (2) and a suction line (3). The cleaning fluid then leaves the high pressure pump and enters on its pressure side, a safety circuit indicated in its entirety by index (4) which is incidentally, housed in a single safety and control block. The high pressure water leaves the safety circuit (4) from its rear and enters a heat exchanger (5). From there the water or superheated steam goes to a high pressure discharge jet (7) through a gun (6).

As required a pump (8) for chemicals can be driven from the pump (2), which draws the cleaning chemicals from containers (9) which are selectable, and as required also from the water tank (1). The deliverd medium and as required, also the cleaning chemicals, can be mixed in through a line (10) which opens into a delivery line (11) after the heat exchanger (5).

The pressurized water enters the safety circuit (4) through a delivery line (12). It opens a non-return valve (13) and flows through a line (14) into a water deficiency safety which mainly consists of a permanent magnet (15) which is retained in a larger through-hole by a spring (16). Outside the through-hole, a reed switch (17) is provided. If the magnet is pushed by the prevailing pressure to the right in the drawing, the reed switch (17) then switches on a magnetic valve for supply of fuel to the heating.

Because the bore of the line (14) is too narrow (ring slot) an auxiliary line (18) is used so that the water can flow freely. The water then leaves the block with the safety circuit through a line (19). It then enters the heat exchanger (5).

If the gun (6) is closed, the pump only runs on for a short time. It has not yet received the switch-off signal. Thus water is still being drawn out of the water tank. The water cannot however flow away on the pressure side. Thus an over-pressure occurs, also from the chemicals pump (8). The over-pressure brings the change-over valve (20) into operation. This works as follows:

A line (30) branches off the line (12) conducting the high pressure cleaning medium. The over-pressure in the branch line (21) emanating from the line (39) pushes a piston (22) which is retained by a spring (23), to the left in the drawing. The piston (22) has the task of moving the ball (24) of a non-return valve (25) to the left, so that the non-return valve opens allowing the medium to flow from the line (42) into the line (12). In this moment the system pressure falls because the pressurized water can reach the suction side of the pump (2) through a line (26). The line (26) is connected to the suction line (3).

The non-return valve (13) now closes. As a result the over-pressure remains between the non-return valve (13) and the closed gun (6). This over pressure overcomes the force of the tensioned spring (23) with the assistance of the piston (22) and thus holds the non-return valve (25) open. In this way a pressure of zero bar prevails in the pump through the non-return valve (25) and the line (26).

At the moment that the spring (23) draws back when the over-pressure is relieved (the spring has a specific travel), this movement is exploited to operate a microswitch (28), through an adjusting screw (27) on the change-over valve (20), which switches off the pump motor.

As soon as the non-return valve (13) closes, the flow between the non-return valve and the closed gun stops. Now the water deficiency safety reacts which mainly consists of the magnet (15) and the reed switch (17).

This ensures that the magnet (15) is pushed back into its seat by the spring (16). At this moment the reed switch operates the magnetic valve which itself switches off the burner. This is therefore the method of operation of the water deficiency safety.

The chemicals pump (8) also does not run anymore because it is driven by the pump (2). Between the gun (6) and the pump pressure valve for the chemicals the same over pressure prevails as in the rest of the system.

Now the spraying procedure is continued and the gun (6) is opened. The over-pressure (retained pressure) between the non-return valve (13) and the gun falls. The spring (23) returns to its original position, the adjusting screw (27) releases the microswitch (28), the ball closes the non-return valve (25) because the piston (22) has moved itself. The pump (2) now operates against a pressure of zero bar and the pumped water opens the non-return valve (13). The magnet (15) moves and brings the burner into operation again by means of the reed switch (17). The equipment is again operational.

To be able to supply steam, a specific, smaller quantity of water as that for hot water operation must be taken through the heat exchanger (5) which in the case of normal burner performance is heated until it vaporizes. Only a part of the complete output capacity of the pump (2) may be delivered to the gun (6). The greater part of the water must be returned to the water tank (1).

This is achieved by a steam valve (29) which has a rotary knob (30) and its attached screw (31) opens a non-return valve (32) which opens immediately by means of spring (33) pressure on a needle (34). The needle is so formed that between it and the valve drilling an exactly defined ring slot is available.

When the water arrives through the line (12) from the pump, the greater part of the water flows through the line (41) through the ring slot mentioned (in the direction of the screw 31). This diverted water then flows through the line (26) back to the suction side of the pump. Only the smaller part of the water capacity goes on to the heat exchanger (5) and is there turned into steam at, for example 160 , which then leaves the equipment as high-pressure superheated steam through the gun (6) and the jet (7).

To ensure operation of the steam stage a time delay in motor starting is necessary for the following reason.

At the start situation the equipment was normally switched off by an automatic switching-off device (28). Between the closed gun (6) and the non-return valve (13) a retained over-pressure prevails. The steam stage is started. The equipment is brought into operation as described above. The motor then runs immediately and delivers water. Because the overpressure between the open gun and the non-return valve (13) does not dissipate so quickly and fresh pressurized water is again demanded from the pump (2) a pressure wave exists between the pump and the non-return valve (13) which slams shut the non-return valve (32) of the steam stage. When it closes it does not open again because the operating pressure is then present. The piston force of the needle (24) is greater than the force of the spring (33) because of the operating pressure.

In order to avoid this pressure wave, the pump (2) may only start and deliver water when the retained over-pressure between the non-return valve (13) and the closed gun (6) has been relieved, i.e. after a specific delay. The steaming process is interrupted by closing of the gun.

Because the pump (2) is still running and the gun (6) is closed an over-pressure is built up, which, at the start flows away through the steam valve (29). If the over-pressure is high enough the steam valve (29) can now close. Until that happens, some seconds can pass. When the steam stage is once closed, the switch off procedure operates as previously described.

In accordance with the invention, a safety valve (35) is provided which is basically of the same design as the change-over valve (20) but without the automatic switch-off device (27)(28). The safety valve (35) has the following tasks:

It serves as the final safety, if the automatic switch-off device (27)(28) and/or the change-over valve (20) are defective, and further, to pick up the residual heating and also to pick up the running-on of the pump. The safety valve (35) is arranged between the gun (6) and the non-return valve (13).

For explanation of the method of operation of the safety valve (35) it is assumed that the jet (7) is blocked. Then the change-over valve comes into operation. Now assume that the change-over valve (20) is defective, for example, sticking. Now the safety valve (35) comes into operation. The over-pressure now occuring acts through a line (36=on a piston (37) of the safety valve, which opens a non-return valve (38). Now the overpressure can be relieved through a line (39), the non-return valve (38) and a line (40) and be directed through a line (26) to the suction side (suction line 3) of the pump (2). For this purpose the line (40) is connected (directly or through the change-over valve 20) to the line (26). The line (39) is connected to the pressure line (12), after the non-return valve (13).

When the equipment is switched off by the automatic switch (28) subsequent to heated operation (hot water or steam), the remaining heat in the heating coil of the heat exchanger (5) and in the burner acts on the closed-off water in the heating coil (between the closed gun and the non-return valve 13). This residual heat creates a further vaporizing of water and thus likewise a nonpermissable overpressure.

Again the safety valve (35) comes into operation as previously described.

The spring (43) of the safety valve (35) is to be adjusted to be stronger than the spring (23) of the valve (20). As a rule it is adjusted so that the safety valve (35) is switched only at a pressure of 20% above the working pressure.

If, by closing of the gun (6), the pump (2) is shut-off by the change-over valve (20) and the automatic switch-off device (27)(28) by the micro-switch (28) a pressure of zero bar prevails in the pump (idling) as previously described. By this idling the pump rotates for some further revolutions till it comes to a standstill.

By these idling revolutions the chemicals pump pumps further however, because it is not connected to the valve (20). It does not have its own change-over valve.

Because the gun and the non-return valve (13) are closed but fluid is still being injected into this area, likewise a nonpermissable over pressure can occur. This overpressure is also picked up by the safety valve (35).

To offer an even higher level of failure safety of the present safety circuit the present invention provides for a high temperature fuse (44) which is fitted on the inlet side of the heat exchanger in line (19).

The high temperature fuse is the last link in the emergency chain and only comes into action if, contrary to expectations, the water deficiency safety (15)(17) and the safety valve (35) both fail.

If such a defect arises the safety valve (35) opens automatically and a reverse flow occurs through the line (36). As the burner does not shut off because of the defect, an increase in temperature follows inside the heat exchanger (5) and, through the line (36) the temperature also rises in stages; when the temperature has reached 108°, the machine is electrically switched off by the high temperature fuse (44) through the control cable (45). In this case the machine includes the drive motor of the pump (2) and the burner.

The high temperature cut out (44) then burns through and must be replaced by a new high temperature fuse before the machine can be switched on again.

The illustration further shows that when the dosage valve (46) of the chemicals pump (8) is opened it is still possible to direct chemicals to the outlet side of the heat exchanger through the line (47). When it is set to zero a clear rinse of the suction line (48) of the chemicals pump occurs.

When, however, the dosage valve is closed, water is drawn through the line (49) from the water tank (1) and pure water is delivered to the outlet side of the heat exchanger (5) through the lines (48)(49)(50) by the chemicals pump (8). In this way it is ensured that in the case of a change of cleaning fluid from chemical A to chemical B the lines (48)(50) are always rinsed clean before the new chemical is introduced into the lines.

What we claim is:

1. In high-pressure cleaning equipment having a source of cleaning fluid and a nozzle with pump means having an inlet and an outlet and a heat exchanger having an inlet and an outlet serially connected by fluid flow line means therebetween for delivery of hot water or steam, a safety circuit for relieving over-pressure in said line means, said safety circuit comprising:

first normally closed relief valve means connected between said outlet and said inlet of said pump means and having a first over-pressure valve;

second normally closed relief valve means connected upstream of said first relief valve means between said outlet and said inlet of said pump means and in parallel with said first relief valve means and having a second over-pressure value, said second over-pressure value being greater than said first over-pressure valve; and said first relief valve means opening in response to pressure in said line means exceeding said first over-pressure value to bypass said pump means and said second relief valve means opening only in response to pressure in said line means exceeding said second over-pressure value to bypass said pump means.

2. High-pressure cleaning equipment as defined in claim 1 which further includes a fluid flow connecting line means between said first and second relief valve means for allowing over-pressure fluid in said fluid flow line means to flow through said connecting line means and said first relief valve when said second relief valve is open.

3. High-pressure cleaning equipment as defined in claims 1 or 2 which further includes steam valve means connected between said first relief valve means and said pump means inlet and outlet for adjusting the flow of fluid from said pump means to said heat exchanger to a lower value when said system is to deliver steam from said nozzle.

4. High-pressure cleaning equipment as defined in claims 1 or 2 which further includes non-return valve means in said fluid flow line means between the connections to said first and second relief valve means for permitting fluid flow from said pump means toward said nozzle.

5. High-pressure cleaning equipment as defined in claim 1 which further includes first and second containers for chemicals, chemical pump means having a suction and an outlet with the outlet connected to said heat exchanger outlet, and a dosage valve means connected between said suction and said source of cleaning fluid and said first and second chemical containers for drawing pure cleaning fluid from the source thereof or a choice of a chemical from said first or second container depending upon the setting of said dosage valve.

6. High-pressure cleaning equipment as defined in claim 2 which further includes first and second containers for chemicals, chemical pump means having a suction and an outlet with the outlet connected to said heat exchanger outlet, and a dosage valve means connected between said suction and said source of cleaning fluid and said first and second chemical containers for drawing pure cleaning fluid from the source thereof or a choice of a chemical from said first or second container depending upon the setting of said dosage valve.

7. High-pressure cleaning equipment as defined in claim 6 which further includes first and second containers for chemicals, chemical pump means having a suction and an outlet with the outlet connected to said heat exchanger outlet, and a dosage valve means connected between said suction and said source of cleaning fluid and said first and second chemical containers for drawing pure cleaning fluid from the source thereof or a choice of a chemical from said first or second container depending upon the setting of said dosage valve.

8. High-pressure cleaning equipment as defined in claim 3 wherein the steam valve causes a reduction of about 50% in the otherwise present cleaning fluid, and the heat exchanger generates a steam temperature of about 150 degrees celsius.

9. High-pressure cleaning equipment as defined in claim 1 which further includes on the inlet side of the heat exchanger a high temperature fuse whose temperature rating is approximately 108 degrees celsius and which when it breaks, switches off the pump means and the heat exchanger.

10. High-pressure cleaning equipment as defined in claim 1 wherein said second over-pressure value is approximately 20% higher than said first over-pressure value.

11. High-pressure cleaning equipment as defined in claim 8 which further includes first and second containers for chemicals, chemical pump means having a suction and an outlet with the outlet connected to said heat exchanger outlet, and a dosage valve means connected between said suction and said source of cleaning fluid and said first and second chemical containers for drawing pure cleaning fluid from the source thereof or a choice of a chemical from said first or second container depending upon the setting of said dosage valve.

12. High-pressure cleaning equipment as defined in claim 9 which further includes first and second containers for chemicals, chemical pump means having a suction and an outlet with the outlet connected to said heat exchanger outlet, and a dosage valve means connected between said suction and said source of cleaning fluid and said first and second chemical containers for drawing pure cleaning fluid from the source thereof or a choice of a chemical from said first or second container depending upon the setting of said dosage valve.

13. High-pressure cleaning equipment as defined in claim 10 which further includes first and second containers for chemicals, chemical pump means having a suction and an outlet with the outlet connected to said heat exchanger outlet, and a dosage valve means connected between said suction and said source of cleaning fluid and said first and second chemical containers for drawing pure cleaning fluid from the source thereof or a choice of a chemical from said first or second container depending upon the setting of said dosage valve.

* * * * *